US005622276A

United States Patent [19]

Simmons

[11] Patent Number: 5,622,276

[45] Date of Patent: Apr. 22, 1997

[54] COLLAPSIBLE CONTAINER/COOLER APPARATUS

[76] Inventor: John M. Simmons, 292 Hwy. 90 #213, Bay St. Louis, Miss. 39520

[21] Appl. No.: 457,974

[22] Filed: Jun. 1, 1995

[51] Int. Cl.[6] ..... B65D 6/16

[52] U.S. Cl. ..... 220/6; 220/7; 220/404

[58] Field of Search ..... 220/6, 7, 404, 220/462, 463

[56] References Cited

U.S. PATENT DOCUMENTS

| | | | |
|---|---|---|---|
| 66,666 | 7/1867 | Rutter | 62/371 |
| 696,754 | 4/1902 | Rogers | 62/457.1 |
| 1,267,840 | 5/1918 | Bertrand | 62/371 |
| 1,936,814 | 11/1933 | Wetta, Sr. | 220/6 |
| 2,720,998 | 10/1955 | Potter | 220/6 |
| 3,484,017 | 12/1969 | O'Donnell | 220/7 |
| 3,552,466 | 1/1971 | Fairchilds | 220/7 |
| 3,658,035 | 4/1972 | Harris | 220/6 |
| 3,675,808 | 7/1972 | Brink | 220/7 |
| 3,756,494 | 9/1973 | Beck, Jr. et al. | 220/404 |
| 3,828,966 | 8/1974 | Martin | 220/6 |
| 3,935,931 | 2/1976 | Kaplan | 220/7 |
| 4,235,346 | 11/1980 | Liggett | 220/7 |
| 4,571,232 | 2/1986 | Diehl | 220/463 |
| 4,603,558 | 8/1986 | McAdams | 62/457.1 |
| 4,903,859 | 2/1990 | Derby et al. | 220/462 |
| 4,925,056 | 5/1990 | McCoig | 220/404 |
| 5,282,542 | 2/1994 | Mo | 220/7 |

*Primary Examiner*—Joseph M. Moy
*Attorney, Agent, or Firm*—Pravel, Hewitt, Kimball & Krieger

[57] ABSTRACT

A portable and collapsible container having a floor portion and four side walls, with the four sidewalls collapsible into a horizontal configuration aligned with the floor portion, and a cover which would fit there onto for the storage configuration. In addition, each of the sidewalls would include an insulated liner with the liner permanently attached to the endwalls and the floor portion, but snapped in place on the two opposing side walls. Therefore, when the container is at its point of destination, the endwalls and sidewalls would be placed in the upright position, and the liner would be resnapped onto the side walls, to configure a container having a fluid permeable liner, and insulated walls so that items could be placed into the container with ice for refrigeration. Furthermore, the top portion would be insulated so that when it is placed on top of the four upright walls, it defines a closed ice chest container. There would be further included snap members adjacent the bottom of the wall portions for engaging the floor portion when the wall members are put in the upright position to assist in maintaining the wall portions in the upright position. Further, there would be included snap members on the four corners of the container for engaging the sidewalls to the endwalls when the container is placed in the ice chest configuration.

18 Claims, 2 Drawing Sheets

36
20
40
38
34

30
38
38
7
40
7
32
28
30
30
40
18
21
19
32
20
24
21
44
25
15

21
8
38
19
21
47
23
8
38
49
40
38
40
49
23
20
19
21
24
44
45
44
14

21
38
20
40
19

COLLAPSIBLE CONTAINER/COOLER APPARATUS

BACKGROUND OF THE INVENTION

1. Field Of The Invention

The apparatus of the present invention relates to containers. More particularly, the present invention relates to a container which serves as a cooler, such as an ice chest, which is portable in nature, and has the ability to collapse into an easily transportable unit, and to be reconfigured into an ice chest with insulated walls or a storage container, as the case may be.

2. General Background

Ice chests have been found to be very useful containers for consumers to transport goods which need to be refrigerated during transport. In most cases, the ice chest is carried manually by individuals, and would enable easy access into the ice chest for the goods stored therein. One shortcoming of ice chests has been the fact that ice chests, because of their nature, usually take up valuable storage room when not in use or when empty, or take up valuable transport space within a car, truck or the like. It would therefore be useful to have an ice chest which could be stored or transported, when empty, in a compact configuration, and yet could be easily assembled into a container which would be insulated and impermeable to fluids, so that it could be utilized as an ice chest at its point of origin.

In pursuing this idea, a patentability search was conducted in the U.S. Patent and Trademark Office and the following patents were noted as a result of that search, and are included herein in the prior art statement:

U.S. Pat. No. 66,666—DEVICE FOR PRESERVING AND TRANSPORTING PERISHABLE ARTICLES;

U.S. Pat. No. 696,754—FOLDING ICE BOX;

U.S. Pat. No. 1,267,840—KNOCKDOWN ISOTHERMAL SHIPPING BOX;

U.S. Pat. No. 2,720,998—COLLAPSIBLE CONTAINER;

U.S. Pat. No. 3,658,035—COLLAPSIBLE AQUARIUM;

U.S. Pat. No. 3,828,966—COLLAPSIBLE BAKING PAN;

U.S. Pat. No. 4,603,558—RECEPTACLE FOR MOUNTING IN A FREEZER FOR ASSISTING IN THE DEFROSTING THEREOF.

SUMMARY OF THE PRESENT INVENTION

The apparatus of the present invention solves the shortcomings in the art in a simple and straightforward manner. What is provided is a portable and collapsible container having a floor portion and four side walls, with the four sidewalls collapsible into a horizontal configuration aligned with the floor portion, and a cover which would fit there onto for the storage configuration. In addition, each of the sidewalls would include an insulated liner with the liner permanently attached to the endwalls and the floor portion, but snapped in place on the two opposing side walls. Therefore, when the container is at its point of destination, the endwalls and sidewalls would be placed in the upright position, and the liner would be resnapped onto the side walls, to configure a container having a fluid permeable liner, and insulated walls so that items could be placed into the container with ice for refrigeration. Furthermore, the top portion would be insulated so that when it is placed on top of the four upright walls, it defines a closed ice chest container. There would be further included snap members adjacent the bottom of the wall portions for engaging the floor portion when the wall members are put in the upright position to assist in maintaining the wall portions in the upright position. Further, there would be included snap members on the four corners of the container for engaging the sidewalls to the endwalls when the container is placed in the ice chest configuration.

Therefore, it is a principal object of the present invention to provide a portable collapsible container which may be stored in a compact configuration and may be reconfigured into a container for housing refrigerated items therein;

It is the further object of the present invention to provide a portable ice chest having an insulated liner which is maintained in the ice chest at all times, yet has the ability to allow the ice chest to fold into a compact storage configuration and to reopen into a ice chest storage unit for storage of ice and food items therein and including an insulated top cover;

It is the further object of the present invention to provide a portable and collapsible ice chest, having an insulated liner which is permanently attached to the endwalls and floor portion so that the endwalls may be folded inward against the floor portion and the sidewalls folded atop the endwalls, with a top position thereon to configure a compact storage container and including snaps for engaging the endwalls to the sidewalls when the container is reconfigured into the ice chest configuration.

BRIEF DESCRIPTION OF THE DRAWINGS:

For a further understanding of the nature and objects of the present invention, reference should be had to the following detailed description taken in conjunction with the accompanying drawings, in which like parts are given like reference numerals, and wherein.

Figure 1:
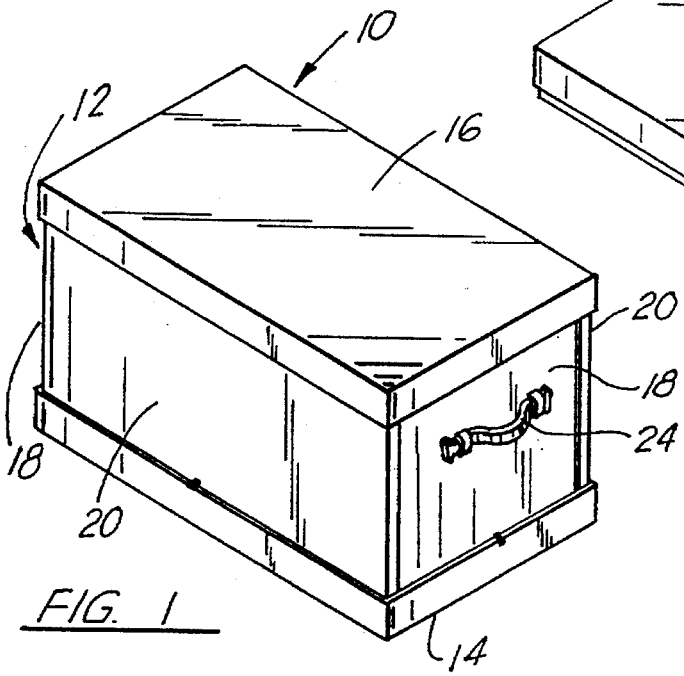
FIG. 1 illustrates an overall perspective view of the ice chest container of the present invention in its storage configuration.
Figure 2:
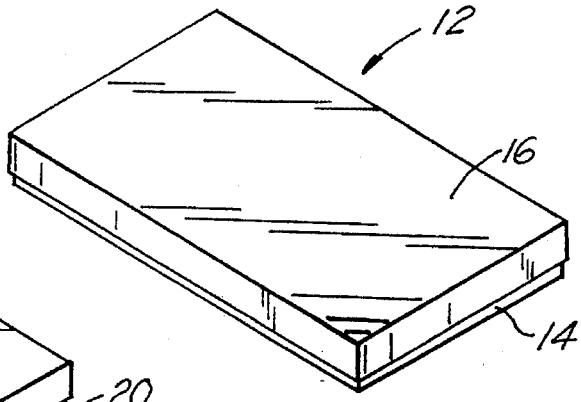
FIG. 2 illustrates an overall perspective view of the ice chest container in its collapsed, stored configuration.
Figure 6:
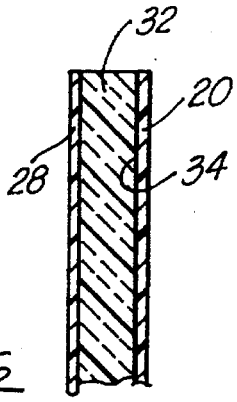
FIG. 6 illustrates a cross-section view of the insulated walls of the present invention.
Figure 3:
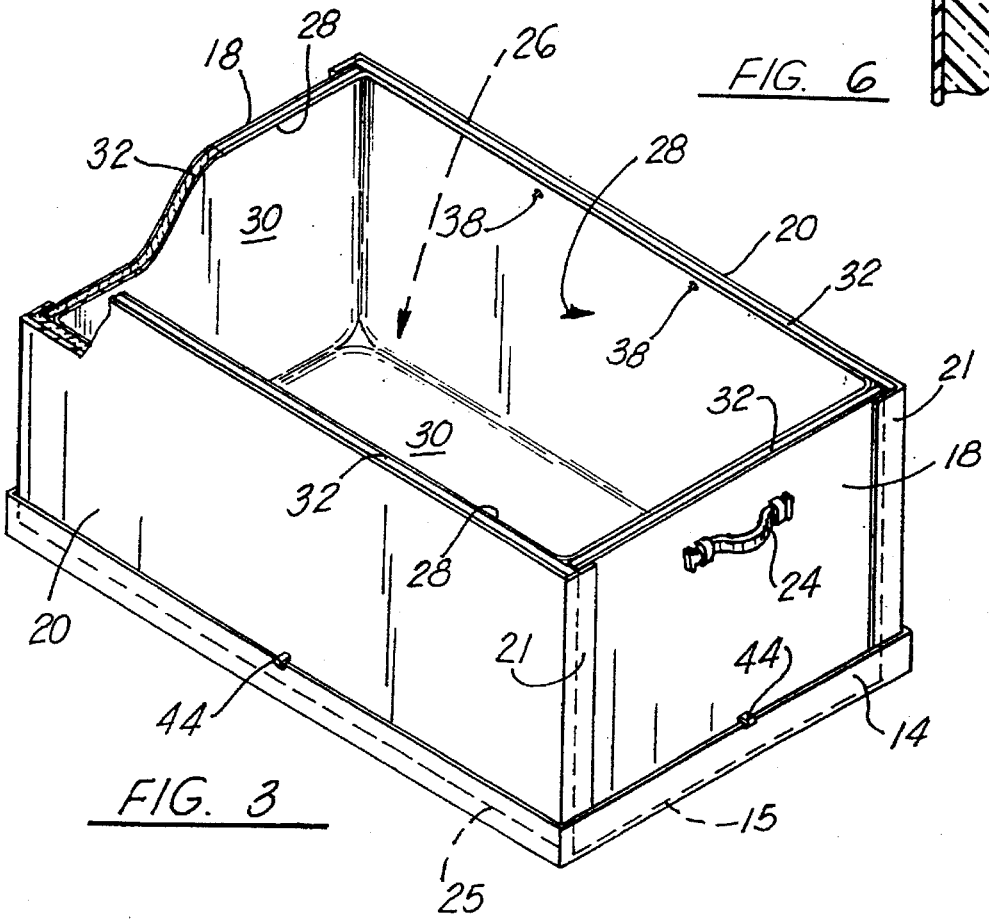
FIG. 3 illustrates a partial cut away view of the ice preferred embodiment of the ice chest container of the present invention.
Figures 4, 5, 7, 8:
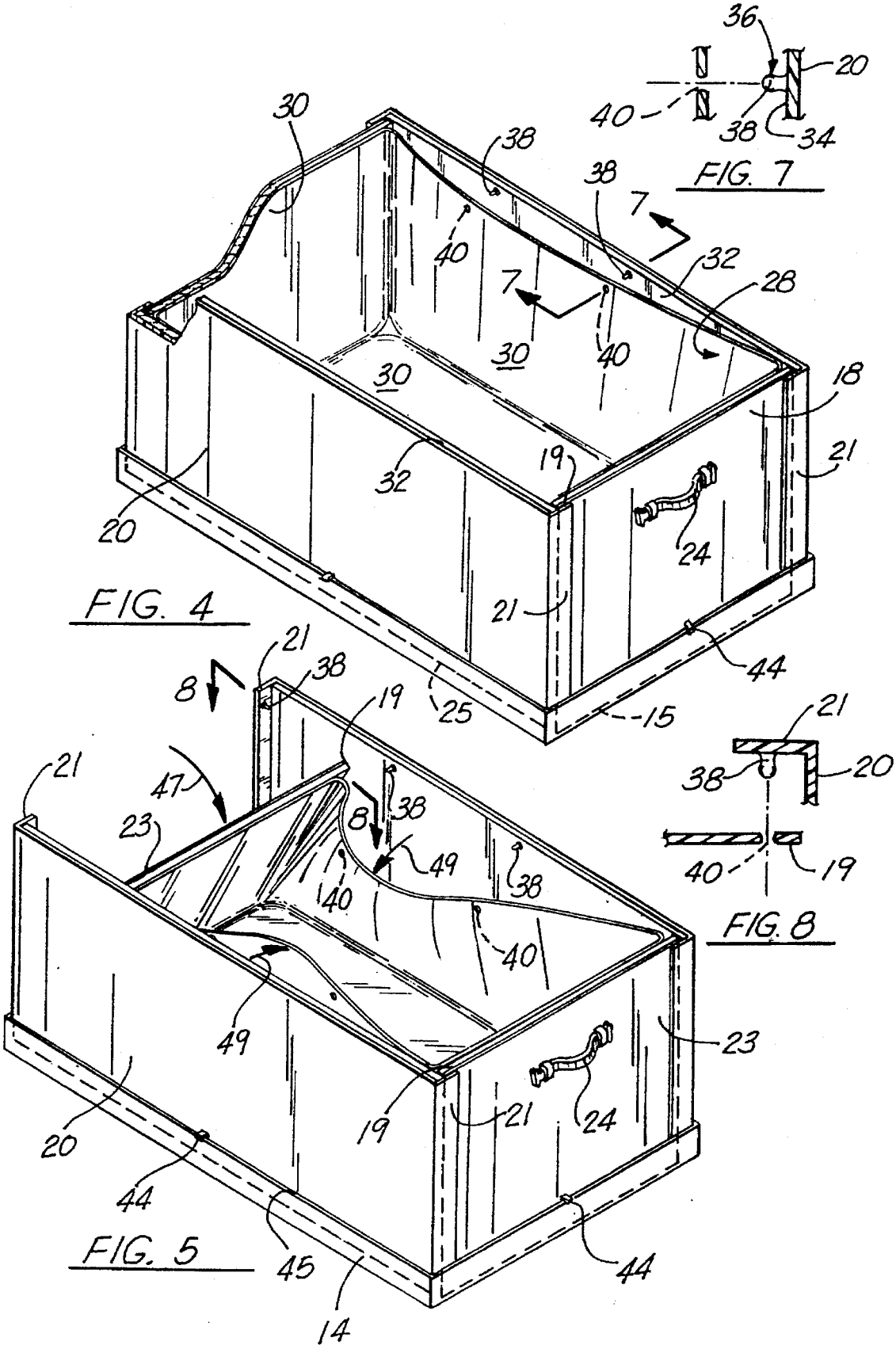
FIGS. 4 and 5 illustrate overall perspective views of the storage container as it is being configured into the collapsed state.
FIG. 7 illustrates a cross sectional view along lines 7—7 in FIG. 4 of the present invention.
FIG. 8 illustrates a cross sectional view along lines 8—8 of FIG. 5 of the present invention.

DETAILED DESCRIPTION OF THE PREFERRED EMBODIMENT:

FIGS. 1–8 illustrate the preferred embodiment of the apparatus of the present invention by the numeral 10. As seen in FIG. 1, apparatus 10 defines a container 12, having a floor portion 14, a removable top portion 16, a pair of endwalls 18, and a pair of sidewalls 20. As seen in FIG. 1, the container would also include a handle member 24 at each end wall 18, of the container 12 for carrying the container 12 during use. As further illustrated in FIG. 3, container 12 is illustrated with the top 16 removable from the container. As illustrated, the container 12 would define a storage space 26 therein as defined by the four walls 18, 20 and floor portion 14. As illustrated, there is a continuous plastic like or water impermeable liner 28, positioned within the storage space 26, and forming the interior surface 30 of the floor portion 14 and the four sidewalls 18, 20. Liner 28 would be of a flexible plastic-like, fluid impermeable material and could therefore house any fluids contained within the container without leakage to the outside. As illustrated in FIG. 6, the liner 28 would be permanently attached to a layer of insulation 32, which would be the type of insulation that may be used in such a container in order to maintain the items stored within the container cool. The insulation layer 32 would be placed against the interior surface 34 of each of the sidewalls 20, and in the preferred embodiment as illustrated in FIG. 3, would be permanently attached through gluing or the like to the two endwalls 18, sidewalls 20, and floor portion 14. However, in other embodiments, the insulation would not necessarily have to be permanently attached to the side walls, but may be set in place during the assembly of the apparatus 10. As explained earlier, as seen in FIG. 4, since the liner 28 is permanently attached to each of the endwalls 18, the attachment means would be gluing or the like. However, since the liner 28 is not permanently attached to each of the sidewalls 20, as seen in FIG. 4, the liner would be secured to each of the sidewalls 20 via a pair of spaced apart snap members 36, and would be detachable therefrom when the apparatus was placed into the storage position as will be discussed further. As seen in isolated view in FIG. 7, the snap members 36 would include a nipple like extension member 38 extending inward from the inner surface 34 of each side wall 20, which would engage an opening 40 in the liner 28 as illustrated in FIGS. 4 and 7. Because of the configuration of the nipple 38, the nipple 38 would frictionally engage the walls of opening 40, and would secure the liner 28 in place as seen in FIG. 3.

Likewise, as seen in FIGS. 5 and 8, when sidewalls 20 are in the upright position, and endwalls 18 are engaged thereto in the upright position, sidewalls 20 include an overlapping portion 21, which overlaps against the end edges 19 of each of the sidewalls 18. Each of the overlapping portions 21 would likewise include a nipple like extension 38, of the type discussed earlier for engaging into an opening 40 in each end wall 20. Therefore, when endwalls 18 are moved to the upright position as seen in FIG. 5, nipple 38 would engage into opening 40 in the end wall 18 and would maintain the end wall in the upright position. Likewise, as seen in the FIGURE, when the endwalls 18 are placed in the upright position, a snap member 44 on endwalls 18 and sidewalls 20 would engage an upper edge 45 of the floor portion 14, and would again assist in holding the four walls 18, 20 upright.

Turning now to the collapsibility of the container 12, reference again is made to FIGS. 2, 4 and 5. As illustrated, when container 12 is to be placed in the collapsed state as seen in FIG. 2, liner 28 would be disengaged from each of the sidewalls 20 as seen in FIG. 4, with the nipple like extension 38 being disengaged from the ports 40. At that point, as seen in FIG. 5, both endwalls 18 would be disengaged from their nipple like extensions 38 and endwalls 18 would be folded inwardly in the direction of arrow 47 with liner 28 of sidewalls 20 likewise being disengaged from extensions 38, and folded inward in the direction of arrows 49, as seen in FIG. 5, so that the liner of sidewalls 20 is folded onto the floor portion 14, prior to the endwalls 18 being folded thereupon. Following this, each of the sidewalls 20, which contain the glued insulation 32, would then be folded so that they are laying horizontally against the outer face 23 of each of the endwalls 18, and after that is accomplished, the top 16 would then be placed on the container as seen in FIG. 2. At that point, container 12 is in the complete storage configuration.

For purposes of construction as seen in FIG. 3, endwalls 18 would fold downward from a joint (phantom line 15) between the lower point of the end wall 18 and the floor portion 14. However, because of the fact that sidewalls 20 would then have to fold on top of the thickness of endwalls 18, each of the sidewalls 20 would be jointed at a point higher than the endwalls along phantom line 25, as illustrated in FIG. 3, and therefore, when they are folded downward, would have the ability to leave sufficient space between the floor 14 and their point of fold 25 so as to accommodate the flat thickness of the endwalls 18. Once they are placed in position, again as seen in FIG. 2, the container 12 is ready for transport.

When the container has reached its destination, the FIGURES illustrate that the sidewalls 20 would be placed upright as seen in FIG. 3, and each of endwalls 18 would be placed to the upright position and snapped against each of the nipple like extensions 38. At that point, the liner 28 would then be reengaged onto the nipples 38, of each of sidewalls 20, and the interior of container 12 would be ready to accept any type of ice or the like which, because of the impermeability of the liner 28, would accommodate such items. Once these are placed therein, the insulated top 16 would then be placed on container 12 as seen in FIG. 1 and container 12 would be functioning as an ice chest.

Of course, if one wished to, one could simply utilize container 12 as a storage container, whether it included the insulation 32 or not. If one simply wished to have a container which was not necessarily insulated but was water impermeable, one could simply utilize the liner 28 in conjunction with the four sidewalls 18, 20 and would not have to utilize the insulation in place. Therefore, container 12 could still house liquid items, but would not be insulated. On the other hand, of course, the container 12, whether it had insulation or not, could still be utilized as a container simply by placing items in container 12 and storing them as seen in FIG. 1.

The following table lists the part numbers and part descriptions as used herein and in the drawings attached hereto.

PARTS LIST

| Description | Part No. |
|---|---|
| apparatus | 10 |
| container | 12 |
| floor portion | 14 |
| phantom line | 15 |
| top portion | 16 |
| endwalls | 18 |
| end edges | 19 |
| side walls | 20 |
| overlapping portion | 21 |
| outer face | 23 |
| handle member | 24 |
| phantom line | 25 |
| storage space | 26 |
| impermeable liner | 28 |
| interior surface | 30 |
| insulation | 32 |
| interior surface | 34 |
| snap members | 36 |
| nipple extension member | 38 |
| opening | 40 |

-continued

PARTS LIST

| Description | Part No. |
|---|---|
| snap member | 44 |
| upper edge | 45 |
| arrows | 47, 49 |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A portable, collapsible insulated container, comprising:

a) a floor portion;

b) four sidewalls, the sidewalls hingedly secured to the floor portion and movable from a first upright position defining a container space therein and foldable inwardly onto the floor portion to a second horizontal, collapsed storage position;

c) an insulated top portion positionable on the sidewalls when the sidewalls are in the upright position to define a closed container space for storing materials therein;

d) a continuous fluid impermeable liner removably attached to the container at intervals along two of the sidewalls, and permanently secured to two of the sidewalls, so that when the four sidewalls are folded inwardly, the two sidewalls having the impermeable liner permanently secured fold inwardly followed by the inward folding of the two sidewalls with the permeable liner removably attached;

e) insulation positioned between the impermeable liner and the four sidewalls and floor portion, so that when the sidewalls are in the upright position, and the top is positioned thereon, the container defines an insulated container space for storing refrigerated items therein.

2. The container in claim 1, wherein there is further included snaps along two of the sidewalls for removably engaging the liner thereto when the two sidewalls are moved to the upright position.

3. The container in claim 1, further comprising snaps along the bottom of the container to snappingly engage the sidewalls to maintain them in the upright position.

4. The container in claim 1, wherein the insulation means further comprises a layer of insulation permanently secured to an inner surface of the sidewalls, portion and top portion of the container, between the side walls of the container and the container liner.

5. The container in claim 1, wherein the liner comprises a continuous layer of flexible plastic material impermeable to fluids such as water so the container can be used as an ice chest.

6. The container in claim 1, wherein the top is positioned on the container after the sidewalls have been folded inward to the horizontal, storage configuration, to define a compact, storable container.

7. A portable, collapsible insulated container, comprising:

a) a floor portion;

b) a pair of opposing sidewalls and a pair of opposing end walls, the sidewalls and end walls hingedl secured to the floor portion and inwardly movable from a first upright position defining a container space therein to a second horizontal, collapsed storage position;

c) a top potion positionable on the sidewalls and end walls when the sidewalls and end walls are in the upright position to define a closed container space for storing materials therein;

d) a continuous fluid impermeable liner positioned within the interior space, and permanently secured to the floor portion and the opposing end walls, but removably secured to the opposing side walls with a plurality of snap members, whereby, upon the sidewalls and end walls being moved inwardly to the second horizontal, collapsed position the opposing end walls are folded inwardly first followed by the inward folding of the opposing sidewalls;

e) a layer of insulation permanently secured within the container, positioned between the liner and the opposing sidewalls, opposing end walls and floor portion, so that when the sidewalls and end walls are in the upright position, and the top is positioned thereon, the container defines an insulated container space for storing refrigerated items therein.

8. The container in claim 7, wherein the layer of insulation is also permanently secured to the top portion of the container.

9. The container in claim 7, wherein there is further included snaps along fie sidewalls for removably engaging the liner thereto when the sidewalls are moved to the upright position.

10. The container in claim 7, further comprising snaps along the bottom of the container to snappingly engage the sidewalls and end walls to maintain them in the upright position.

11. The container in claim 7, wherein the liner comprises a continuous layer of flexible plastic material impermeable to fluids such as water so the container can be used as an ice chest.

12. The container in claim 7, wherein the top is positioned on the container after the sidewalls and the end walls have been folded inwardly to the horizontal, storage configuration, to define a compact, storable container.

13. The container in claim 7, wherein the end walls are collapsed to the horizontal and the sidewalls are collapsed atop the end walls when configured to the compact, storage configuration.

14. The container in claim 7, wherein the sidewalls are foldable along a line raised sufficiently from the floor portion to accommodate the thickness of the end wails which have been folded down to the horizontal position.

15. A portable container comprising:

a) a rigid outer container portion, further comprising:

i) a floor portion;

ii) a pair of opposing sidewalls and a pair of opposing end walls hingedly secured to the floor portion and foldable from a first upright position inwardly to a horizontal position against the floor portion;

b) a top portion positionable on the sidewalls and end walls when they are in the upright position; and c) a continuous fluid impermeable liner secured permanently along the interior space at the floor portion and end walls, and removably secured to the sidewalls so that when the sidewalls and end walls are in the upright position, and the top is positioned thereon, there is defined a container for storing items therein, and when the sidewalls and end walls are folded inwardly to the horizontal position, the liner is disengaged from the sidewalls so that the end walls may first be folded inwardly against the floor portion and the sidewalls may be subsequently folded inwardly on the end walls so that the top may be placed thereupon in a storage configuration.

16. The container in claim 15, wherein the end walls are collapsed to the horizontal, the side walls are collapsed atop the end walls, and the top is positioned on the container after the sidewalls and the end walls have been folded inwardly to the collapsed configuration, defining a compact, storable container.

17. The container in claim 15, wherein the sidewalls are foldable along a line raised sufficiently from the floor portion to accommodate the thickness of the end walls which have been folded down to the horizontal position.

18. The container in claim 15, further comprising a layer of insulation permanently secured within the top portion, and secured within the container positioned between the liner and the sidewalls, end walls and floor portion to define an insulated container space for storing refrigerated items.

* * * * *